US005782676A

United States Patent [19]

Pedersen

[11] Patent Number: 5,782,676

[45] Date of Patent: Jul. 21, 1998

[54] RESILIENT LIFTER FOR WIRE COIL BLAST CLEANING APPARATUS

[75] Inventor: John A. Pedersen, Oakville, Canada

[73] Assignee: Blast Cleaning Products Ltd., Oakville, Canada

[21] Appl. No.: 963,442

[22] Filed: Nov. 3, 1997

Related U.S. Application Data

[62] Division of Ser. No. 610,056, Feb. 29, 1996.

[30] Foreign Application Priority Data

Jan. 9, 1996 [CA] Canada ..... 2166820

[51] Int. Cl.[6] ..... B24B 3/08

[52] U.S. Cl. ..... 451/82; 451/95; 451/97; 242/613.2; 242/129

[58] Field of Search ..... 451/80, 82, 95, 451/97, 398, 399, 401, 402; 242/613.1, 613.2, 129

[56] References Cited

U.S. PATENT DOCUMENTS 3,540,669 11/1970 Schmidt .

4,657,202 4/1987 Sauber .

4,757,646 7/1988 Goetz .

*Primary Examiner*—Eileen P. Morgan

*Attorney, Agent, or Firm*—Riches, McKenzie & Herbert

[57] ABSTRACT

The present invention relates to an improved lifter for a blast cleaning apparatus for cleaning coiled wire with abrasive cleaning material. A prior art apparatus for blast cleaning wires comprises an elongated boom provided with annular splitters for longitudinal separation of wire coils and metal lifters for radial separation of wire coils to expose substantially all of the surface of the wires to the abrasive cleaning material. Due to the hardness of the lifters, some abrasive cleaning material becomes embedded in the wire and causes problems with subsequent processing steps. The present invention provides a resilient lifter for a blast cleaning apparatus which overcome this and other difficulties. Preferably, the lifters according to the present invention are made of polyurethane and are used in combination with a conventional boom with or without splitters.

7 Claims, 3 Drawing Sheets

RESILIENT LIFTER FOR WIRE COIL BLAST CLEANING APPARATUS

This application is a division of U.S. application Ser. No. 08/610,056, filed Feb. 29, 1996.

BACKGROUND OF THE INVENTION

This invention relates to improvements in a wire coil blast cleaning apparatus, and more particularly to improved radial lifters for use in such an apparatus.

Lengths of wire comprising a plurality of circular coils may be cleaned in an apparatus such as that shown and described in U.S. Pat. No. 4,757,646 to Goetz. Such cleaning is a necessary step in processes for manufacturing a wide variety of objects such as bolts, axles, nails, etc., and is typically performed prior to drawing the wire through a die. The wire must be completely cleaned before it is drawn through the die.

Goetz teaches a wire coil blast cleaning apparatus having a wire coil support in the form of an elongate boom enclosed in a blast cleaning chamber. A length of coiled wire is slipped over the boom, and the boom is then rotated. Rotation of the boom causes rotation of the wire and displacement of the wire longitudinally along the boom.

During rotation of the boom, abrasive cleaning material is directed at the wire at high velocity from a plurality of different angles by a plurality of throwing wheels located within the blast cleaning chamber.

In order to completely clean the wire, abrasive cleaning material must contact surfaces of the wire located between individual coils of wire. The boom taught by Goetz is therefore provided with annular plates, referred to as "splitters", which assist in creating longitudinal spaces between adjacent coils of wire, and radial "lifters" which radially separate coils of wire along the boom. The longitudinal and radial separation of individual wire coils accomplished by the splitters and the lifters allows individual wire coils to be exposed to the abrasive material.

Radial lifters must be resistant to abrasive materials and must be able to support heavy wire coils weighing up to about 6,000 pounds. Therefore, radial lifters such as those taught in the Goetz patent are made from very hard metal alloys, with manganese steel being preferred. Typically, such metal alloys are harder than the wire being cleaned. This results in a number of disadvantages.

Firstly, and most seriously, it has been observed that abrasive cleaning material thrown at the wire becomes trapped between the hard metal lifters and the wire supported on the lifters. This abrasive material is typically in the form of small, round particles referred to as "shot". A typical diameter of such shot is about 0.017 inches. The shot has a hardness greater than that of the wire. Because the lifter is also harder than the wire, particles of abrasive material trapped between the lifter and the wire tend to be driven into and embedded in the wire. After the cleaning process is completed, some of this shot remains embedded in the wire and causes serious problems during subsequent processing steps, such as when the wire is drawn through a die.

Secondly, even if the shot does not remain embedded in the wire after the cleaning step, scratching of the wire caused by the hard metal lifters and the particles of shot driven into the wire is undesirable.

Thirdly, hard metal lifters such as those taught by Goetz have sharp, angular edges. This is due to the fact that hard metal lifters are fabricated by cutting and welding together pieces of sheet metal, rather than being cast from molten metal. It is difficult to fabricate lifters which do not have any sharp edges. The particular lifters shown in the Goetz patent have "squared off" front and rear ends. It has been observed that wire, particularly small diameter wire, tends to bunch up at the squared ends of the lifters, resulting in tangling of the wire.

Therefore, the prior art wire coil blast cleaners having hard metal lifters, as taught by the Goetz patent, have serious disadvantages, some of which are discussed above. These disadvantages prevent the Goetz blast cleaning apparatus from achieving maximum efficiency in cleaning coiled wire.

SUMMARY OF THE INVENTION

Accordingly, it is an object of the present invention to at least partially overcome the disadvantages of the prior art discussed above.

Therefore, it is one object of this invention to provide improved radial lifters for use in a wire coil blast cleaning apparatus.

It is another object of this invention to provide a wire coil blast cleaning apparatus having improved radial lifters.

Accordingly, in one of its broad aspects, the present invention resides in providing a blast cleaning apparatus for cleaning a wire comprising a plurality of coils, the apparatus comprising: a blast cleaning chamber; a wire coil support located within the cleaning chamber, comprising an elongate, cylindrical boom having a longitudinal axis, the boom being rotatable about the longitudinal axis, and a plurality of resilient lifters provided in spaced relation along the boom, the lifters having at least an outer layer comprised of a flexible, polymeric material and the lifters being adapted to radially separate coils of wire; at least one blast cleaning means located within the cleaning chamber adapted to direct abrasive cleaning material at the wire; and means for rotating the boom about the longitudinal axis.

Also, in another of its broad aspects, the present invention resides in providing a resilient blast cleaning lifter having a longitudinal axis, a bi-laterally symmetrical trapezoid-like cross-sectional shape in a plane parallel to the longitudinal axis of the lifter, and a crescent-like cross-sectional shape in a plane transverse to the longitudinal axis of the lifter, the lifter having a bottom surface adapted to sit on an outer surface of a cylinder having a longitudinal axis parallel to the longitudinal axis of the lifter, and the lifter having at least an outer layer comprised of a flexible, polymeric material.

BRIEF DESCRIPTION OF THE DRAWINGS

Further aspects and advantages of the present invention will become apparent from the following description, taken together with the accompanying drawings in which.

DETAILED DESCRIPTION OF THE PREFERRED EMBODIMENTS

Preferred embodiments of the present invention are now described with reference to FIGS. 1 to 4.

Figure 1:
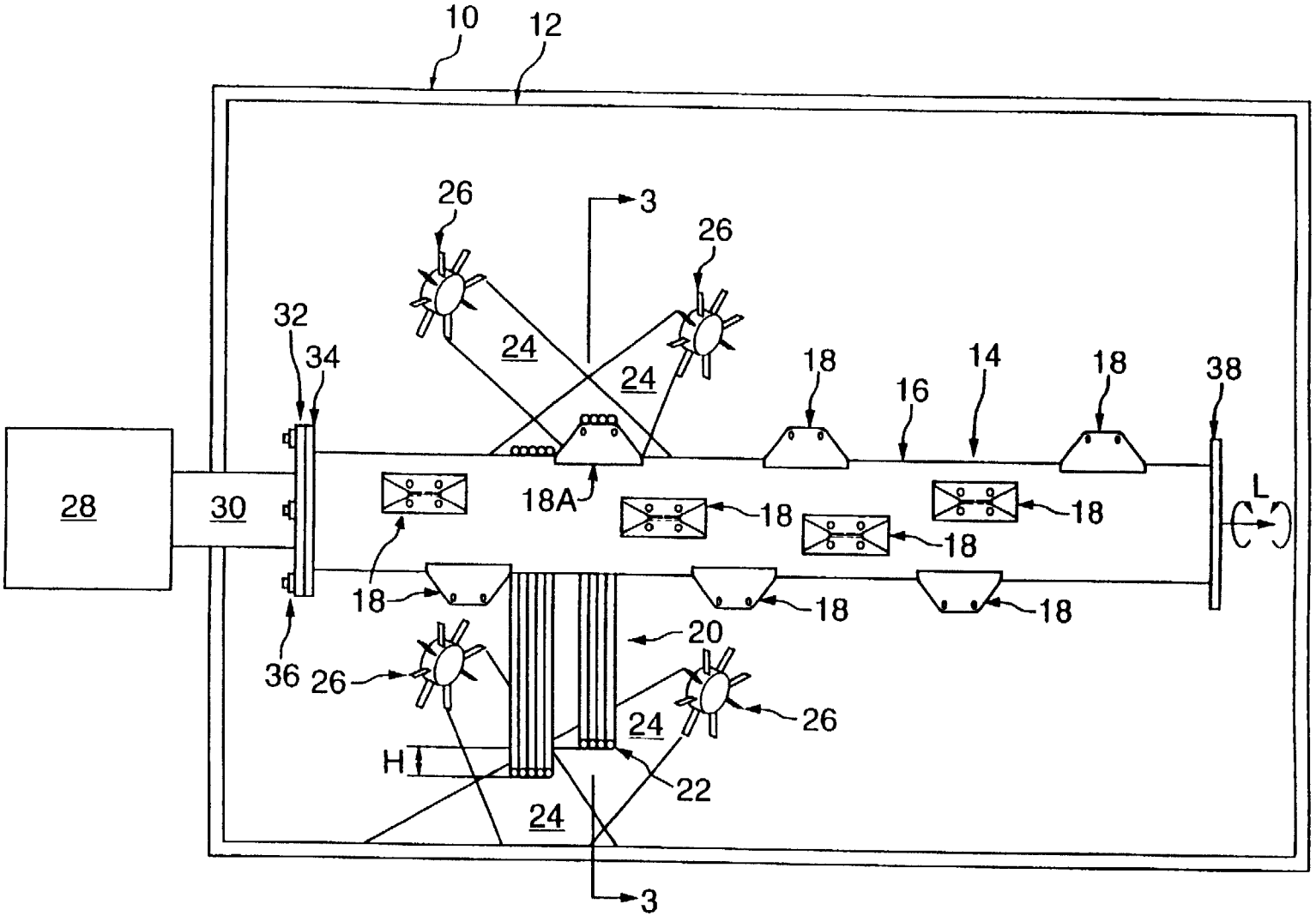
FIG. 1 is a schematic side elevational view, partly in cross-section, of a preferred wire coil blast cleaning apparatus according to the present invention.

FIG. 1 schematically illustrates a preferred blast cleaning apparatus 10 according to the present invention. The blast cleaning apparatus shown in FIG. 1 comprises a blast cleaning chamber 12 enclosing a wire coil support 14 comprising an elongate, cylindrical boom 16 having a longitudinal axis L, with boom 16 being rotatable about longitudinal axis L.

A plurality of resilient lifters 18 are provided in spaced relation to one another along the length of boom 16 and about its circumference. The spacing of the resilient lifters 18 shown in FIG. 1 merely illustrates a possible configuration of the lifters 18 on boom 16. It is to be understood that other arrangements of the lifters 18 on boom 16 will produce satisfactory results.

Preferably, the spacing of the lifters 18 along the boom 16 is such that adjacent lifters 18 are displaced both circumferentially and longitudinally relative to one another.

As shown in FIG. 1, a length of wire 20 comprising a plurality of circular coils 22 is supported on the wire coil support 14 of apparatus 10. For clarity, wire 20 is shown in cross-section. However, it is to be appreciated that the coils 22 of wire 20 completely extend around the wire coil support 14.

Cleaning of wire 20 is accomplished by simultaneously rotating wire coil support 14 carrying wire 20 about axis L and "throwing" abrasive cleaning material 24 from a plurality of blast cleaning wheels 26 at wire 20. The rotation of wire coil support 14 causes rotation of wire 20. Because the coiled wire 20 is in the form of a spiral, rotation of wire 20 caused by support 14 results in longitudinal displacement of wire 20 along support 14.

To accomplish rotation of wire support 14, a motor 28 is provided, preferably outside of the blast cleaning chamber 10. Preferably, the motor 28 is capable of rotating the wire coil support 14 in both directions about longitudinal axis L, resulting in forward and rearward longitudinal displacement of wire 20 along support 14. Motor 28 is also preferably capable of rotating support 14 at various speeds to allow wire 20 to be longitudinally displaced along support 14 at various speeds.

The motor 28 is preferably connected to wire coil support 14 by means of a shaft 30 extending through chamber 12, shaft 30 being connected to a mounting plate 32 inside chamber 12. A mounting flange 34 provided at the end of boom 16 is joined to plate 32 by means of bolts 36 shown in FIG. 1.

A second end flange 38 is preferably provided at the end of boom 16 opposite the mounting flange 34. Together, flanges 34 and 38 on boom 16 prevent wire 20 from becoming longitudinally displaced beyond the ends of boom 16 during rotation of the wire coil support 14.

As shown in FIG. 1, some of the coils 22 of wire 20 are supported on top of a resilient lifter, which is labelled 18A for convenience, but which is identical to the other lifters 18. The remaining coils 22 of wire 20 are supported on the surface of boom 16.

Figure 3:
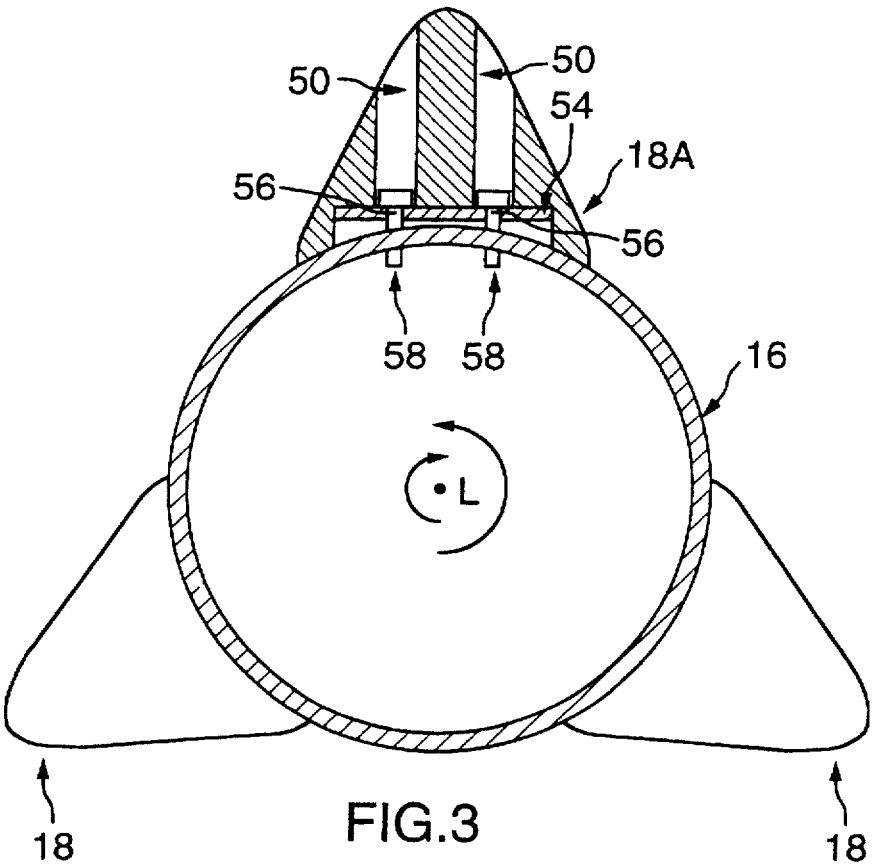
FIG. 3 is a cross-sectional view of the wire coil support of the blast cleaning apparatus shown in FIG. 1 taken along line 3—3 of FIG. 1.

Lifter 18A is shown in FIGS. 1 and 3 as having reached its maximum vertical displacement during rotation of support 14. That is, lifter 18A is directed vertically upwardly. In this position, some of the coils 22 of wire 20 are supported by lifter 18A and are displaced radially (vertically) a distance H above the remaining coils 22 of wire 20 which are supported on boom 16. As support 14 is rotated, and wire 20 is rotated and longitudinally displaced, different coils 22 of wire 20 become radially displaced by various lifters 18 at various locations along the support 14. Preferably, the radial displacements produced are such that each coil 22 becomes exposed to abrasive cleaning material 24, resulting in complete cleaning of wire 20.

The lifters 18 have at least an outer layer comprised of a flexible, polymeric material. However, the entire lifter 18 may be formed from the flexible, polymeric material.

The lifters 18 have a hardness which is considerably less than that of prior art hard metal alloy lifters. Further, the hardness of the lifters 18 is less than that of the wire 20 and less than that of the abrasive cleaning material 24. Therefore, when abrasive cleaning material 24 becomes trapped between wire 20 and resilient lifter 18, it is driven into and becomes embedded in the resilient lifter 18 rather than in the wire 20. After the weight of the wire 20 is removed from the lifter 18, most or all of the abrasive material 24 "pops" out of the resilient lifter 18.

Because the abrasive material 24 is driven into resilient lifter 18, substantially no abrasive material 24 becomes embedded in wire 20. Therefore, the use of resilient lifters 18 substantially overcomes the serious problems in subsequent processing steps, such as drawing of the wire 20 through a die, due to shot embedded in the wire 20. Also, because the abrasive material 24 is driven into resilient lifters 18, less scratching of the wire 20 is caused by contact of the wire 20 with the trapped abrasive material 24.

Further, because the lifters 18 are much softer than the wire 20, the wire 20 is not scratched by contact with the lifters 18.

Preferably, the flexible, polymeric material is resilient and durable in an abrasive environment and is selected from the group comprising polyurethane, rubber, and ultra-high molecular weight (UHMW) plastic such as UHMW polyethylene, with polyurethane being particularly preferred.

Most preferably, the polyurethane used for lifter 18 has the following physical properties:

| | |
|---|---|
| Hardness, Shore A: | 90 |
| Tensile Strength, psi, (Die D) | 4500 to 7500 |
| 100% Modulus, psi | 1050 to 1100 |
| 300% Modulus, psi | 1650 to 2100 |
| Tear Strength, pli | 400 to 450 |
| Elongation, % | 350 to 520. |

Preferably, lifters 18 according to the present invention are formed by moulding the flexible, polymeric material. This allows the lifters 18 to have rounded corners and a smooth contour which prevents the tangling problems encountered with prior art hard, sharp-edged metal lifters fabricated from sheet metal. A preferred shape of lifters 18 is now described below.

Figure 2:
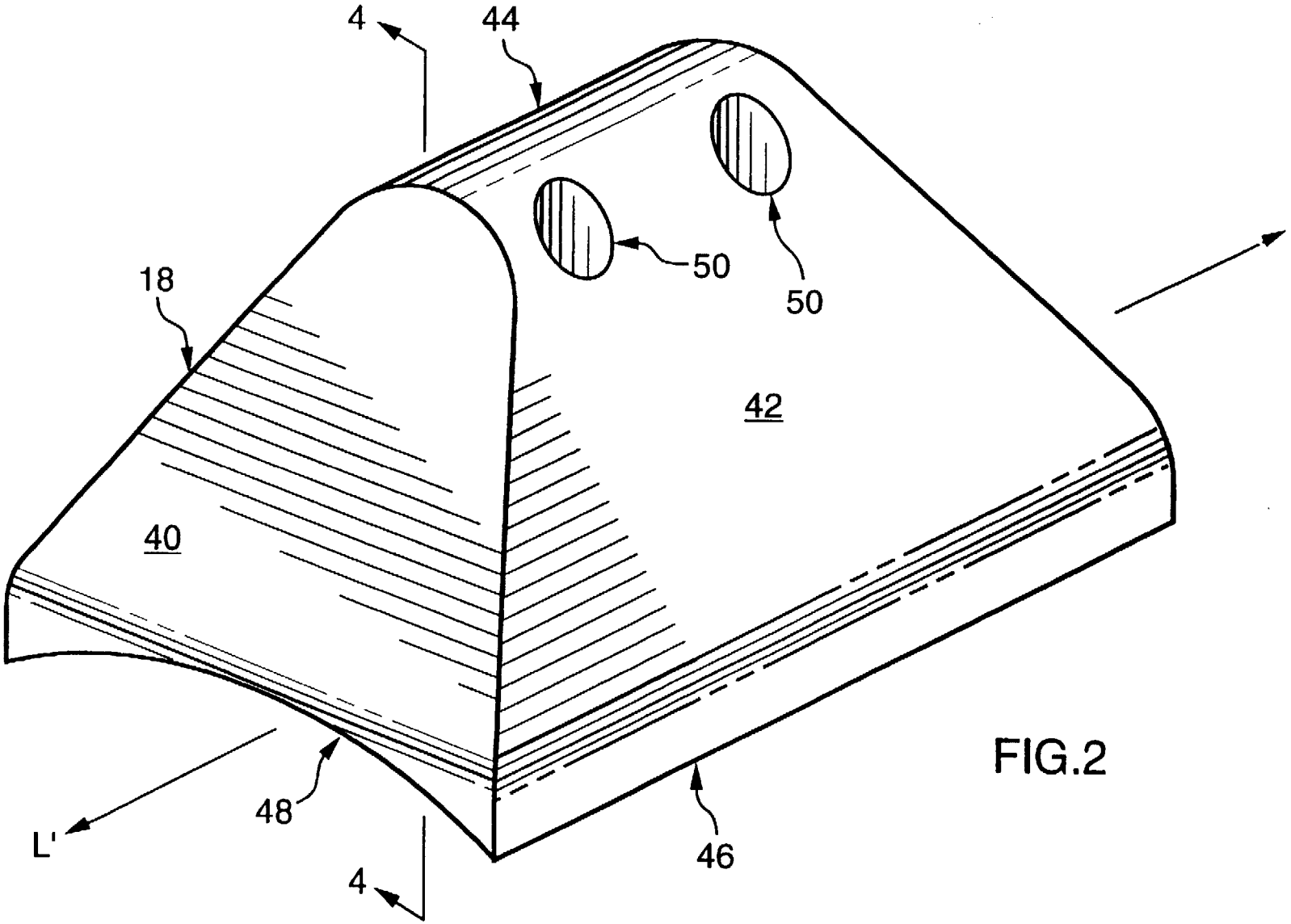
FIG. 2 is a perspective view of a preferred resilient lifter according to the present invention.

FIG. 2 is a perspective view of a preferred resilient lifter 18 according to the present invention. Lifter 18 has a sloped front surface 40 having a crescent-like shape, an identical rear surface 41 (not shown), a side surface 42 having an approximately bilaterally symmetrical trapezoidal shape, and a smoothly rounded upper surface 44. The term "bilaterally symmetrical trapezoidal shape" as defined herein excludes rectangular shapes.

About the bottom of lifter 18 is provided a base 46, with the transitions between the base, front surface, side surface and upper surface preferably being smoothly rounded. The base portion 46 of lifter 18 is provided with an arch 48 so that lifter 18 may sit on the outer cylindrical surface of a boom 16 such as shown in FIG. 3, the longitudinal axis L' of lifter 18 being parallel to the longitudinal axis L of boom 16 shown in FIG. 1.

The sloped front surface 40 and rear surface 41 are advantageous in that they help to prevent tangling of wire 20. As wire 20 moves longitudinally along wire support 14, the wire 20 will be pushed against a sloped surface 40 or 41 of a resilient lifter 18. Because surfaces 40 and 41 are sloped, wire 20 will be pushed upward along slope 40 or 41 rather than being bunched up, as would be the case if front and rear surfaces 40 and 41 were vertical.

Further, the lifter 18 preferably has a relatively flat upper surface 44 upon which the wire coils may be supported as the boom is rotated. The upper surface 44 may be gently rounded as shown in FIG. 2 or may be flat.

Preferably, fastener holes 50 are provided on each side surface 42 of lifter 18, into which fasteners such as bolts or screws (not shown in FIG. 2) may be inserted in order to secure the lifter 18 to a boom 16.

FIG. 3 illustrates a cross-sectional view of wire coil support 14 of FIG. 1 in a plane perpendicular to longitudinal axis L and through line 3—3 of FIG. 1.

As shown in FIG. 3, preferred lifter 18 is formed from a moulded block 52 of a flexible, polymeric material and has a metal support plate 54 embedded therein. Support plate 54 is preferably formed from a hard, rigid material such as steel. Support plate 54 is provided with four holes 56, only two of which are shown in FIG. 3, each hole 56 being concentric with a fastener hole 50 provided in moulded block 52.

Lifter 18 is preferably secured to boom 16 by means of fasteners such as bolts 58 which are inserted through fastener holes 50 in moulded block 52 and holes 56 in plate 54 to be fastened to boom 16. Although it is to be understood that several means exist for attaching a fastener to boom 16, FIG. 3 illustrates bolts 58 being threaded into threaded holes 60 in boom 16.

Figure 4:
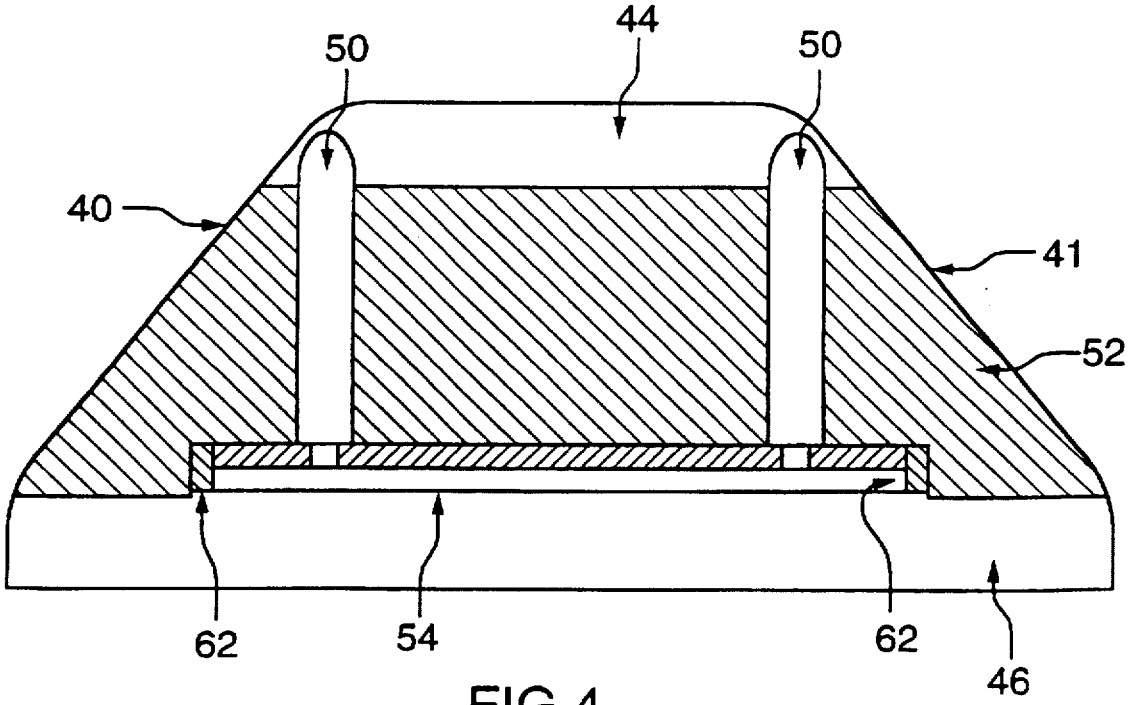
FIG. 4 is a side elevational view, partly in cross-section, of a resilient lifter according to the present invention taken along line 4—4 of FIG. 2.

FIG. 4 is a side elevational view partly in cross-section, of the preferred resilient lifter 18 shown in FIG. 2. FIG. 4 more clearly illustrates the structure of the moulded block 52 and illustrates a particularly preferred form of support in which support plate 54 additionally comprises a vertical skirt portion 62 to provide improved strength to support plate 54.

Although the invention has been described in connection with certain preferred embodiments, it is not intended to be limited thereto. Rather, it is intended that the invention cover all alternate embodiments as maybe within the scope of the following claims.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

I claim:

1. A resilient blast cleaning lifter having a longitudinal axis, a bi-laterally symmetrical trapezoid cross-sectional shape in a plane parallel to the longitudinal axis of the lifter, and a crescent cross-sectional shape in a plane transverse to the longitudinal axis of the lifter, the lifter having a bottom surface adapted to sit on an outer surface of a cylinder having a longitudinal axis parallel to the longitudinal axis of the lifter, and the lifter having at least an outer layer comprised of a flexible, polymeric material, wherein the lifter has sufficient hardness to withstand impact with abrasive cleaning material during blast cleaning of a workpiece.

2. The lifter of claim 1 wherein the flexible, polymeric material is selected from the group comprising polyurethane, rubber and ultra high molecular weight plastics.

3. The lifter of claim 2 wherein the flexible, polymeric material is polyurethane.

4. The lifter of claim 3, wherein the lifter is comprised of a moulded block of polyurethane having a metal support plate embedded therein.

5. The lifter of claim 3 wherein the polyurethane has the following physical properties:

| | |
|---|---|
| Hardness, Shore A: | 90 |
| Tensile Strength, psi, (Die D) | 4500 to 7500 |
| 100% Modulus, psi | 1050 to 1100 |
| 300% Modulus, psi | 1650 to 2100 |
| Tear Strength, pli | 400 to 450 |
| Elongation, % | 350 to 520. |

6. A resilient blast cleaning lifter having a longitudinal axis, a bi-laterally symmetrical trapezoid cross-sectional shape in a plane parallel to the longitudinal axis of the lifter, and a crescent cross-sectional shape in a plane transverse to the longitudinal axis of the lifter, the lifter having a bottom surface adapted to sit on an outer surface of a cylinder having a longitudinal axis parallel to the longitudinal axis of the lifter, and the lifter having at least an outer layer comprised of a flexible, polymeric material, wherein the flexible, polymeric material is polyurethane having the following physical properties:

| | |
|---|---|
| Hardness, Shore A: | 90 |
| Tensile Strength, psi, (Die D) | 4500 to 7500 |
| 100% Modulus, psi | 1050 to 1100 |
| 300% Modulus, psi | 1650 to 2100 |
| Tear Strength, pli | 400 to 450 |
| Elongation, % | 350 to 520. |

7. The lifter of claim 6, having a metal support plate embedded therein.

* * * * *